United States Patent [19]

Suzuki

[11] Patent Number: 4,922,795

[45] Date of Patent: May 8, 1990

[54] TONE SIGNAL FORMING DEVICE

[75] Inventor: Hideo Suzuki, Hamamatsu, Japan

[73] Assignee: Yamaha Corporation, Hamamatsu, Japan

[21] Appl. No.: 272,085

[22] Filed: Nov. 16, 1988

[30] Foreign Application Priority Data

Nov. 17, 1987 [JP] Japan ..... 62-288316

[51] Int. Cl.[5] ..... G10H 1/08; G10H 1/12; G10H 7/00

[52] U.S. Cl. ..... 84/608; 84/623; 84/624; 84/625; 84/626

[58] Field of Search ..... 84/1.01, 1.09–1.13, 84/1.19–1.27, DIG. 9, 608, 622–633

[56] References Cited

U.S. PATENT DOCUMENTS

| | | | |
|---|---|---|---|
| 4,018,121 | 4/1977 | Chowning | 84/1.01 |
| 4,301,704 | 11/1981 | Nagai et al. | 84/1.22 |
| 4,416,179 | 11/1983 | Wachi | 84/1.19 |
| 4,455,911 | 6/1984 | Yamada | 84/1.19 |
| 4,528,885 | 7/1985 | Chihana | 84/1.1 |
| 4,558,624 | 12/1985 | Tomisawa et al. | 84/1.26 |
| 4,646,612 | 3/1987 | Suzuki | 84/1.22 |
| 4,656,912 | 4/1987 | Deutsch | 84/1.22 |
| 4,677,889 | 7/1987 | Deutsch | 84/1.01 |

FOREIGN PATENT DOCUMENTS 62127899 8/1983 Japan .

*Primary Examiner*—Stanley J. Witkowski
*Attorney, Agent, or Firm*—Spensley Horn Jubas & Lubitz

[57] ABSTRACT

A parameter generation circuit sequentially generates different tone forming parameters by timewise changing them in a predetermined sequence. A sequence control circuit performs a control so as to repeat the sequential generation of the different tone forming parameters in the parameter generation circuit. The sequentially generated tone forming parameters are applied to a tone forming circuit in which a tone signal having tone color characteristics based on these tone forming parameters is formed. The tone color characteristics of the tone signal formed undergo timewise change due to the timewise change in the tone forming parameters. By repeating the sequential generation sequence of the tone forming parameters, an adequate tone color variation can be realized notwithstanding that a relatively small number of tone forming parameters may be used. Depending upon the tone forming system used in the tone forming circuit, various tone forming parameters such as filter coefficients, harmonic coefficients and frequency modulation operation parameters may be used for forming of the tone signal.

11 Claims, 3 Drawing Sheets

TONE SIGNAL FORMING DEVICE

BACKGROUND OF THE INVENTION

This invention relates to a tone signal forming device employing a system for forming a tone signal having desired tone color characteristics in accordance with tone signal forming parameters such as a system for forming a tone signal by a filter control using a digital filter, a tone synthesis system using a frequency modulation operation and a tone synthesis system using an amplitude modulation operation and, more specifically, to realizing timewise change in the tone color in such tone signal forming device.

As a tone signal forming device for forming a tone signal of a desired tone color by a filter control using a digital filter, there is known a device disclosed in Japanese Patent Application Laid-Open No. Sho 62-127899 (corresponding to U.S. Pat. Application Ser. No. 934,781 now U.S. Pat. No. 4,841,828). In realizing timewise change in the tone color in this device, plural sets of different filter coefficients are stored in a memory and these coefficients are read out sequentially with a lapse of time and supplied to the digital filter.

Similarly, in other tone synthesis systems using tone forming parameters, plural sets of different tone forming parameters are stored in a memory and these parameters are sequentially read out with a lapse of time to form a tone in accordance with the read out parameters.

However, for continuously changing filter coefficients or other tone forming parameters one after another during sounding a tone which lasts a long time, considerable number of filter coefficients or other tone forming parameters must be stored in a memory and this necessitates a memory of a considerably large capacity. In view of economic considerations and the size of the device, there is a limit to the number of parameters which can be prepared with a result that it is difficult to realize adequate timewise change in the tone color for a tone such as a sustain tone which has a relatively long sounding time.

SUMMARY OF THE INVENTION

It is, therefore, an object of the invention to provide a tone signal forming device capable of realizing adequate timewise change in the tone color with an economized construction.

The tone signal forming device according to the invention comprises parameter generation means for sequentially generating different tone forming parameters by timewise changing them in a predetermined sequence, sequence control means for performing a control for repeating the sequential generation of the different tone forming parameters in the parameter generation means by repeating at least a part of the sequence, and tone forming means receiving the tone forming parameters generated by the parameter generation means for forming a tone signal having tone color characteristics based on these tone forming parameters.

The parameter generation means sequentially generates different tone forming parameters by timewise changing them one after another in accordance with a predetermined sequence. The generated tone forming parameters are applied to the tone forming means and a tone having tone color characteristics based on these tone forming parameters is formed by the tone forming means. By the timewise change in the tone forming parameters in the predetermined sequence, the tone color of the tone formed by the tone forming means undergoes timewise change. The sequence control means performs a control for repeating the sequence. The sequential generation of the tone forming parameters in accordance with the sequence is thereby repeated so that timewise change in the tome of the tone signal formed by the tone forming means in accordance with the sequence is repeatedly realized.

Accordingly, even if the number of the tone forming parameters used in one sequence is limited, the tone color can be repeatedly changed during necessary sounding time so that adequate timewise change in the tone color can be realized with a simple circuit construction. Moreover, a sway can be imparted to the tone color by repeating the tone color changing sequence whereby a rich tone color free from monotonousness can be realized.

An embodiment of the invention will now be described with reference to the accompanying drawings.

BRIEF DESCRIPTION OF THE DRAWINGS

In the accompanying drawings.

DESCRIPTION OF A PREFERRED EMBODIMENT

Figure 1:
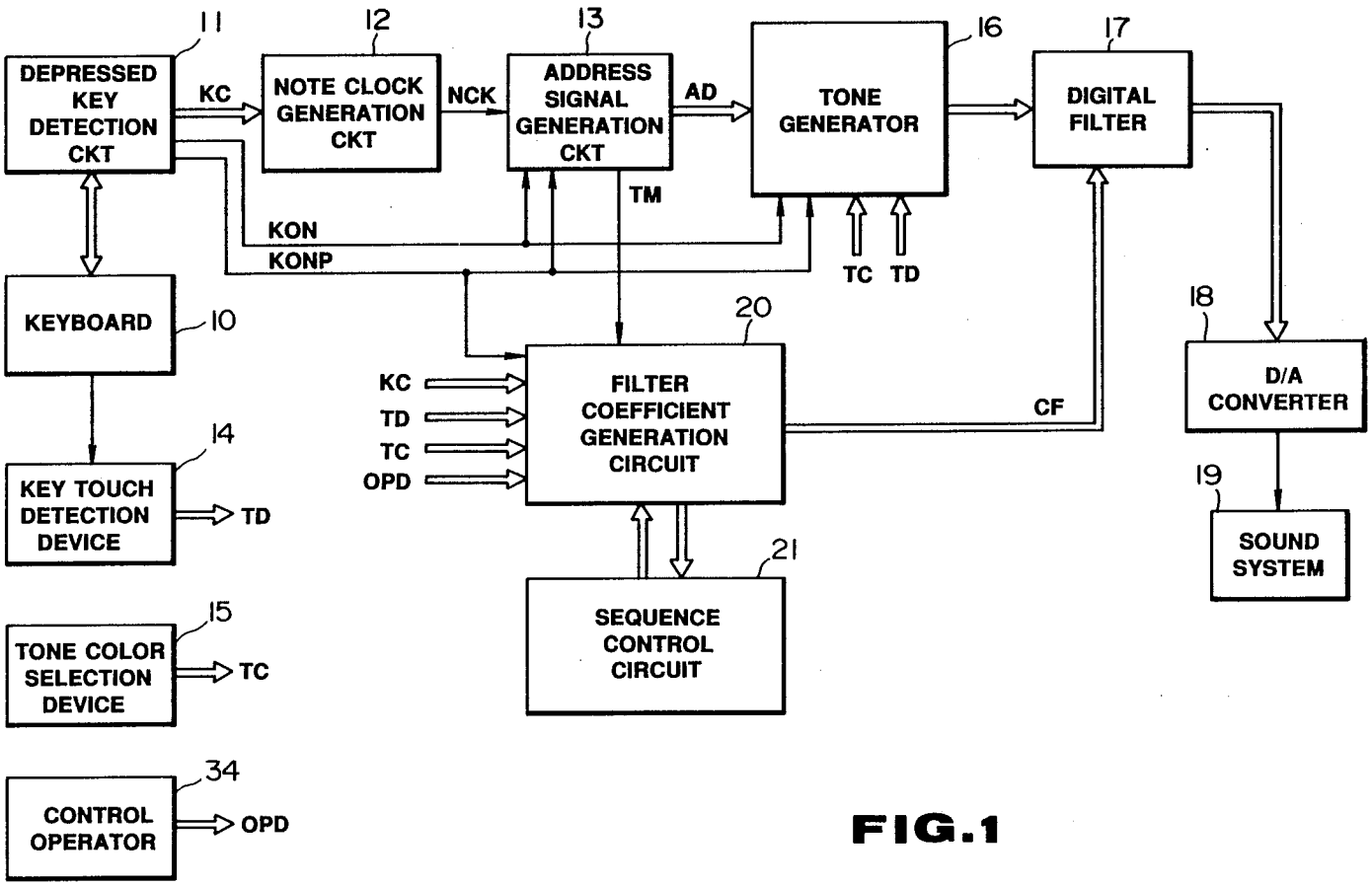
FIG. 1 is a block diagram showing an embodiment of an electronic musical instrument incorporating the tone signal forming device according to the invention.

FIG. 1 is an embodiment of the invention applied to a tone signal forming device adapted to form a tone signal of a desired tone color by a filter control using a digital filter and, more particularly, an embodiment of the tone signal forming device according to the invention applied to an electronic musical instrument of a keyboard type.

In FIG. 1, a keyboard 10 has a plurality of keys for designating tone pitches of tones to be generated. A depressed key detection circuit 11 detects a key depressed in the keyboard 10 and thereupon produces a key code KC for descriminating the depressed key, a key-on signal KON (a signal which maintains a state "1" during depression of a key) and a key-on pulse KONP (a pulse which is turned temporarily to "1" at the beginning of depression of the key). For brevity of explanation, the illustrated electronic musical instrument is assumed to be a monophonic musical instrument and, when plural keys have been depressed simultaneously, the depressed key detection circuit 11 produces the signals KC, KON and KONP with respect to a single depressed key in accordance with a predetermined single tone preferential selection standard. It should be noted that a polyphonic specification will be achieved by employing a known key assigner device.

A note clock generation circuit 12 generates a note clock pulse NCK of a frequency corresponding to the tone pitch of the depressed key in response to the key code KC provided by the depressed key detection circuit 11. This note clock pulse NCK is supplied to an address signal generation circuit 13. This address signal generation circuit 13 counts the note clock pulse NCK and generates an address signal AD for accessing tone waveshape sample value data. The address signal generation circuit 13 produces also a timing signal TM each time it has generated address signals AD for one cycle of the tone waveshape. This timing signal TM is used as a reference signal of time measuring for a timewise change control of tone color. Depending upon the tone signal generation system adopted in a tone generator 16, the address signal AD corresponding to phase of one cycle of the tone waveshape only may be repeatedly generated or the address signal AD corresponding to phase over plural cycle of the tone waveshape may be generated only once or repeatedly. The address signal AD may be reset to its initial value in response to the key-on pulse KONP provided by the depressed key detection circuit 11.

A key touch detection device 14 detects touch applied to the depressed key in the keyboard 10. The device 14 may detect either one of initial touch and after touch. The key touch detection device 14 produces touch data TD representing the detected key touch. A tone color selection device 15 consists of a group of operators for selecting a tone color of a tone to be generated and produces a tone color code TC representing the tone color name of a selected tone color.

The tone generator 16 generates, responsive to the address signal AD provided by the address signal generation circuit 13, digital tone waveshape sample value data and imparts a tone volume envelope to the tone in response to the key-on signal KON and the key-on pulse KONP provided by the depressed key detection circuit 11. Any known tone signal generation system may be employed for tone generation in the tone generator 16. Known tone signal generation systems which can be employed include, for example, a system in which tone waveshape sample value data stored in a waveshape memory is sequentially read out in response to the address signal AD which changes with the tone pitch of the tone to be generated (memory reading system), a system in which tone waveshape sample value data is obtained by executing a predetermined frequency modulation operation using the address signal AD as phase angle parameter date (FM system) and a system in which tone waveshape sample value data is obtained by executing a predetermined amplitude modulation operation using the address signal AD as phase angle parameter date (AM system). If the memory reading system is used, a tone waveshape stored in the waveshape memory may be a waveshape of one cycle only but a waveshape of plural cycles is preferable in improving the tone quality. As the system in which a waveshape of plural cycles is stored in a waveshape memory and read out from it, various systems are known which include, for example, a system disclosed in U.S. Pat. No. 4,383,462 in which a full waveshape from start of sounding of a tone to the end thereof is stored and this waveshape is read out once, a system disclosed in Japanese Patent Application Laid-Open No. Sho 58-142396 in which a waveshape of plural cycles of attack portion and a waveshape of one or plural cycles of sustain portion are stored and the waveshape of the attack portion is read out once and thereafter the waveshape of the sustain portion is repeatedly read out, and a system disclosed in U.S. Pat. No. 4,633,749 in which dispersely sampled waveshapes are stored, a waveshape to be read out is designated by timewise changing it one after another and the designated waveshape is repeatedly read out. Any one of these known systems may be employed in the tone generator 16. The tone color code TC and the touch data TD may be applied to the tone generator 16 and a tone signal having a tone color determined or controlled in accordance with these data may be generated by the tone generator 16.

The digital tone waveshape sample value data generated by the tone generator 16 is applied to a digital filter 17. The digital tone waveshape sample value data provided by the digital filter 17 is applied to a digital-to-analog converter 18 in which the data is converted to an analog tone signal and this analog signal is supplied to a sound system 19 for sounding of the tone.

The digital filter 17 performs filter operation against a digital tone signal provided by the tone generator 16 in accordance with filter characteristics set therein for subjecting the tone signal to tone color setting control, tone color timewise change control and other controls. The filter characteristics are determined in accordance with a set of filter coefficients CF provided by a filter coefficient generation circuit 20.

The filter coefficient generation circuit 20 sequentially generates different sets of filter coefficients by timewise changing these sets in a predetermined sequence. This circuit 20 constitutes "parameter generation means for sequentially generating different tone forming parameters by timewise changing them in a predetermined sequence".

A sequence control circuit 21 is provided in association with the filter coefficient circuit 20. The sequence control circuit 21 performs control so as to repeat the sequential generation of the different sets of filter coefficients by repeating the sequence of generation of the sets of filter coefficients in the filter coefficient generation circuit 20.

The filter characteristics of the digital filter 17 should preferably be determined in accordance with various tone color setting and controlling factors. For this purpose, for example, the filter coefficient generation circuit 20 should preferably be supplied with the tone color code TC for performing the steady tone color setting in accordance with the tone color kind selected by the tone color selection device 15, with the touch data TD for performing the tone color control and other control in response to the key touch, with the key code KC for performing the tone color control and other control in response to the tone pitch (or tone range), with the key-on pulse KONP and the timing signal TM for performing the variable tone color control in response to lapse of time after depression of the key and with output data OPD of a suitable control operator 34 for performing the tone color control in response to manual operation by the player, so that filter coefficients CF are generated in accordance with these various tone color setting and controlling factors. For performing a sequence control responsive to these data TC, TD, KC and OPD, these data may be supplied also to the sequence control circuit 21.

Figure 2:
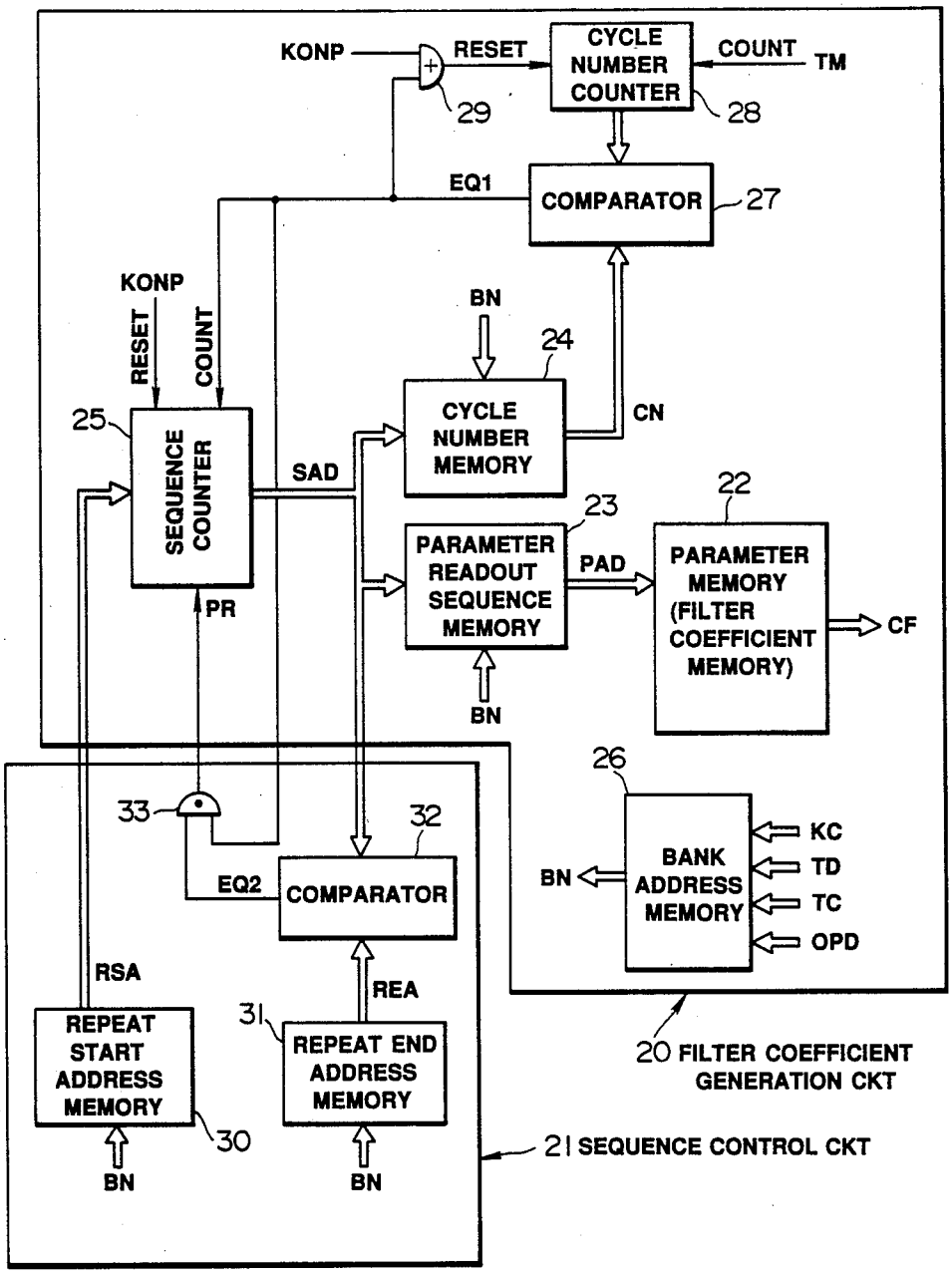
FIG. 2 is a block diagram showing an example of each of a filter coefficient generation circuit and a sequence control circuit in FIG. 1.

An example of each of the filter coefficient generation circuit 20 and the sequence control circuit 21 will be described with reference to FIG. 2.

In the filter coefficient generation circuit 20, a parameter memory 22 stores a number of sets of filter coefficients. A parameter readout sequence memory 23 stores parameter address data PAD for designating a set of filter coefficients to be read out from the parameter memory 22. The memory 23 stores plural parameter address data PAD in a predetermined sequence and sequentially provides each parameter address data in this sequence by timewise changing it one after another in response to input of sequence address data SAD. A cycle number memory 24 stores data for setting timing of changing the set of filter coefficients to be read out from the parameter memory 22 as data in the form of cycle number of tone waveshape, i.e., cycle number data CN and provides this cycle number data CN by timewise changing it in response to the input of the sequence address data SAD. The sequence address data SAD is generated by a sequence counter 25.

Figure 3:
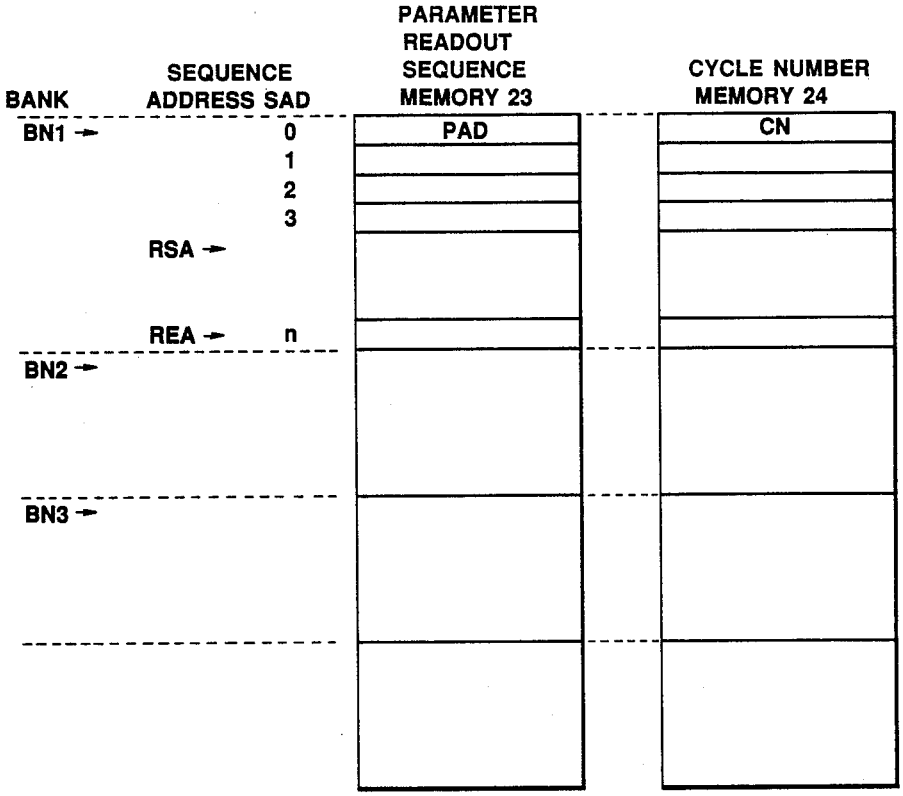
FIG. 3 is a diagram showing an example of each of memory maps of a parameter reading sequence memory and a frequency memory.

An example of each of memory maps of the parameter readout sequence memory 23 and the cycle number memory 24 is shown in FIG. 3. These memories 23 and 24 have plural banks BN1, BN2, BN3, . . . These banks BN1, BN2, BN3, . . . correspond respectively to individual sequences. When a desired tone is formed, one bank (one of BN1, BN2, BN3, . . . ) is designated by bank address data BN and a sequence corresponding to this designated bank is selected. The bank address data BN is generated by a bank address memory 26.

To the bank address memory 26 are applied various tone color setting and controlling factors such as the above described tone color code TC, touch data TD, key-code KC, and operator output data OPD and bank address data BN for designating one bank (one of BN1, BN2, BN3, . . . ) is read out in response to the input data.

One address has plural addresses 0, 1, 2, . . . n and an address among the addresses 0, 1, 2, . . . n at which the stored data should be read out is designated by the sequence address data SAD.

The sequence counter 25 is reset to key-on starting time (time of starting sounding) by the key-on pulse KONP and thereafter performs upcounting by 1 when a signal "1" is produced as coincidence output EQ1 from a comparator 27.

The comparator 27 compares the cycle number data CN produced by the period number memory 24 with the count output of the cycle number counter 28 and, when the two data coincide with each other, produces a signal "1" as the coincidence output EQ1. The cycle number counter 28 is reset to the key-on starting time (time of starting sounding) by the key-on pulse KONP supplied through an OR gate 29 and thereafter performs upcounting by 1 each time the timing signal TM is applied from the address signal generation circuit 13 (i.e., each time sounding of one cycle of the tone waveshape has been made). The coincidence output EQ1 of the comparator 27 is applied to a reset input of the cycle number counter 28 so that the cycle number counter 28 is reset when a cycle number corresponding to the cycle number data CN has been counted by the cycle number counter 28.

In the filter coefficient generation circuit 20, one bank (one of BN1, BN2, BN3, . . . ) in the parameter readout sequence memory 23 and the cycle number memory 24 designated by the band address data BN is brought into a state in which reading can be made. Upon start of depression of a key, the count of the sequence counter 25 is reset to "0", the initial address 0 in the bank is designated by the sequence address data SAD, the cycle number data CN stored at the address 0 is read out from the cycle number memory 24 and the parameter address data PAD stored at the address 0 is read out from the parameter readout sequence memory 23. A set of filter coefficients are read out from the parameter memory 22 in response to this parameter address data PAD and applied to the digital filter 17 (FIG. 1). In this manner, the digital filter 17 is set to filter characteristics corresponding to these filter coefficients.

Upon generation of tone waveshapes of the same cycle number as the cycle number data CN, the comparison output EQ1 of the comparator 27 becomes "1", the count of the sequence counter 25 becomes 1, the second address 1 in the bank is designated by the sequence address data SAD, the cycle number data CN stored at the address 1 is read out from the cycle number memory 24 and the parameter address data PAD stored at the address 1 is read out from the parameter readout sequence memory 23. In accordance with change in the parameter address data PAD, the set of filter coefficients read out from the parameter memory 22 are changed so that the filter characteristics of the digital filter 17 are also changed.

As described above, each time the tone waveshape cycle number of a tone to be generated has reached the cycle number programmed in the cycle number memory 24, i.e., as time elapses, the sequence address data SAD provided by the sequence counter 25 increases and this causes the parameter address data PAD read out from the parameter readout sequence memory 23 to change. This change in the parameter address data PAD in turn brings about change in the set of filter coefficients read out from the parameter memory 22 with resulting timewise change in the filter characteristics of the digital filter 17.

The sequence control circuit 21 comprises a repeat start address memory 30, a repeat end address memory 31, a comparator 32 and an AND gate 33. The repeat start address memory 30 stores repeat start address data RSA designating a start address for repeating a sequence for each bank BN1, BN2, BN3, . . . , i.e., for each sequence. The repeat start address data RSA of one bank (one of BN1, BN2, BN3, . . . ) is read out in response to the bank address data BN. This repeat start address data RS is supplied to a present data input of the sequence counter 25.

A repeat end address memory 31 stores repeat end address data REA designating an end address for repeating a sequence for each bank BN1, BN2, BN3, . . . , i.e., for each sequence. The repeat end address data REA of one bank (one of BN1, BN2, BN3, . . . ) is read out in response to the bank address data BN. This repeat end address data REA is supplied to the comparator 32.

To the other input of the comparator 32 is applied the sequence address data SAD provided by the sequence address counter 25. Upon reaching of the sequence address data SAD to the same value as the end address data REA, coincidence output EQ2 of the comparator 32 becomes a signal "1" and this signal "1" is applied to an AND gate 33. To the other input of the AND gate 22 is applied the coincidence output EQ1 of the comparator 27. Upon lapse of the cycle number of the cycle number data CN in the repeat end address, the AND gate 33 is enabled to provide a signal "1" to a present control input PR of the sequence counter 25 thereby causing the repeat start address data RSA to be present in the sequence counter 25. The sequence counter 25 continues upcounting responsive to the coincidence output EQ1 of the comparator 27 using this time the present repeat start address data RS A as the initial value. The sequence counter 25 is of a preset preference type and does not perform upcounting responsive to the coincidence output EQ1 of the comparator 27 when the repeat start address data RSA is preset.

In the above described manner, a sequence address in one bank, i.e., one sequence, designated by the sequence address data SAD starts from address "0" at the start of sounding of the tone as described above and changes to "1", "2", . . . and one sequence ends when the sequence address has reached the address designated by the repeat end address data REA. Then, the sequence address returns to the address designated by the repeat start address data RSA and thereafter the sequence from the address designated by the repeat start address data RSA to the address designated by the repeat end address data REA is repeated. By this arrangement, during sounding of the tone, the filter characteristics of the digital filter 17 are repeatedly changed whereby adequate timewise change of the tone color can be realized.

Figure 4:
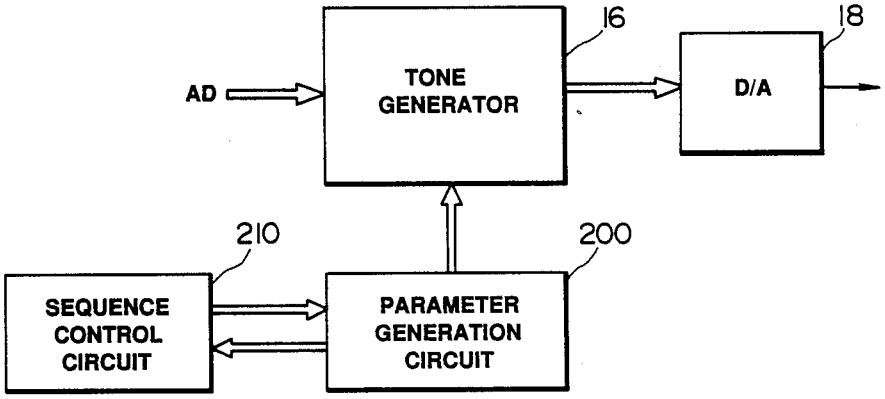
FIG. 4 is a block diagram showing another embodiment of the invention.

This invention can be applied not only to a case where a tone signal of a desired tone color is formed by the filter control using a digital filter but also to cases where other tone color forming systems are used. FIG. 4 shows an example of such other cases. In FIG. 4 the tone generator 16 is controlled by a tone forming parameter generated by a parameter generation circuit 200 and a tone signal having a tone color characteristic corresponding to the parameter thereby is produced. If the tone forming system of a desired tone in the tone generator 16 is the frequency modulation operation system, the tone forming parameter generated by the parameter generation circuit 200 is a frequency modulation operation parameter. In this case, plural sets of different frequency modulation operation parameters are sequentially generated by timewise changing them in a predetermined sequence and supplied to the tone generator 16. In this case, the parameter generation circuit 200 may be constructed substantially in the same manner as the filter coefficient generation circuit 20 in FIG. 2 except that the parameters stored in the parameter memory 22 are substituted by the frequency modulation operation parameters. A sequence control circuit 210 may be constructed substantially in the same manner as the sequence control circuit 21 in FIG. 2.

In FIG. 4, if the tone forming system of a desired tone in the tone generator 16 is the amplitude modulation operation system, the tone forming parameter generated by the parameter generation circuit 200 is an amplitude modulation operation parameter. In this case, plural sets of different amplitude modulation operation parameters are sequentially generated by timewise changing them in a predetermined sequence and supplied to the tone generator 16. In this case, the parameter generation circuit 200 may be constructed substantially in the same manner as the filter coefficient generation circuit 20 in FIG. 2 except that the parameter stored in the parameter memory 22 is substituted by the amplitude modulation operation parameters.

In FIG. 4, if the tone forming system of a desired tone in the tone generator 16 is the harmonics synthesis operation system, the tone forming parameter generated by the parameter generation circuit 200 is a harmonic coefficient. In this case, sets of different harmonic coefficients are sequentially generated by timewise changing them in a predetermined sequence and supplied to the tone generator 16. In this case, the parameter generation circuit 200 may be constructed substantially in the same manner as the filter coefficient generation circuit 20 in FIG. 2 except that the parameter stored in the parameter memory 22 is substituted by the harmonic coefficient.

In the above described embodiment, the parameter address PAD is stored in the parameter readout sequence memory in a predetermined sequence, the parameter address data PAD is once read out as the sequence progresses, and the parameter such as filter coefficients is read out from the parameter memory 22 in accordance with this parameter address data PAD. The invention is not limited to this but the parameter such as filter coefficients may be stored directly in a predetermined sequence and this parameter may be read out directly as the sequence progresses.

In the above described embodiment, only one sequence is provided for the rise portion of a tone and the sequence for the sustain portion of a tone is repeated. The invention is not limited to this but a sequence for other part may be repeated or the entire sequence may be repeated.

In the above described embodiment, for timewise control, the control for changing the parameter is performed in accordance with the cycle number by using the timing signal TM associated with the cycle of the tone waveshape. The invention however is not limited to this but the control for timewise changing the parameter may be performed by using a clock signal corresponding to time or other timing signal.

The coding system of waveshape data in the waveshape memory in the tone generator 16 is not limited to the PCM system but other suitable system such as the difference PCM system and the delta modulation (DM) system may be employed.

In the embodiment of FIG. 1, the note clock pulse NCK is generated in response to the address signal AD. Alternatively, the address signal AD may be generated by computing a numerical value corresponding to the tone pitch frequency.

This invention is applicable not only to forming of a tone signal of a scale not but also to forming of a tone signal of rhythm sound (percussion instrument sound).

As described above, according to the invention, by sequentially generating different tone forming parameters by timewise changing them one after another in a predetermined sequence and repeating this sequence, the tone color can be repeatedly changed during necessary sounding time of the tone despite the limited number in the sets of the tone forming parameter whereby adequate timewise change in the tone color can be realized with a simple circuit construction. Besides, by repeating of the tone color change sequence, a sway effect can be imparted to the tone color with a result that a rich tone color free from monotonousness can be realized.

What is claimed is:

1. A tone signal forming device comprising: parameter generation means for sequentially generating different tone forming parameters by timewise providing them from a memory in a predetermined sequence in order to change a tone color;

sequence control means for performing a control for repeating the sequential generation of the different tone forming parameters in said parameter generation means by repeating at least a part of said sequence; and tone forming means receiving the tone forming parameters generated by said parameter generation means for forming a tone signal having tone color characteristics based on these tone forming parameters.

2. A tone signal forming device as defined in claim 1 wherein said tone forming means comprises a digital filter whose filter characteristics are controlled by a given filter coefficient and said tone forming parameters are filter coefficients.

3. A tone signal forming device as defined in claim 1 wherein said tone forming means forms a tone signal by frequency modulation operation and said tone forming parameters are frequency modulation operation parameters.

4. A tone signal forming device as defined in claim 1 wherein said tone forming means forms a tone signal by harmonic synthesis operation and said tone forming parameters are harmonic coefficients.

5. A tone signal forming device as defined in claim 1 which further comprises selection means for selecting said different tone forming parameters to be generated by said parameter generation means.

6. A tone signal forming device as defined in claim 5 wherein said selection means is a tone color selector for selecting a desired tone color.

7. A tone signal forming device as defined in claim 5 wherein said selection means selects a set of the different tone forming parameters in response to tone pitch or tone range of a tone to be generated.

8. A tone signal forming device as defined in claim 5 which further comprises a keyboard having a plurality of keys for selecting a tone pitch of a tone to be generated and said selection means detects touch of a key depressed in said keyboard and selects a set of the different tone forming parameters in response to the detected touch.

9. A tone signal forming device as defined in claim 5 wherein said selection means comprises an operator for selecting or controlling said different tone forming parameters.

10. A tone signal forming device as set out in claim 1, wherein said parameter generation means comprises:

a parameter memory for storing said tone forming parameters;

a parameter read out sequence memory for storing addresses of said parameter memory; and sequence memory read out controller means for controlling the read out of addresses from said parameter read out sequence memory in sequence and, thereby, controlling the read out of said parameter memory.

11. A tone signal forming device comprising:

parameter memory means for storing different tone forming parameters;

sequential read control means for sequentially reading out the different tone forming parameters from said parameter memory means by timewise changing them one after another in a predetermined sequence to thereby change tone color and repeating the sequential reading of the different tone forming parameters by repeating at least a part of said sequence; and tone forming means, receiving the tone forming parameters read out from said parameter memory means, for forming a tone signal having tone color characteristics based on these tone forming parameters.

* * * * *